US006575171B1

(12) United States Patent
Jacquin

(10) Patent No.: US 6,575,171 B1
(45) Date of Patent: Jun. 10, 2003

(54) AUTOMATED NAIL POLISH REMOVER

(75) Inventor: Heidi Jacquin, Freestone, CA (US)

(73) Assignee: Sofspin, LLC, Freestone, CA (US)

( * ) Notice: Subject to any disclaimer, the term of this patent is extended or adjusted under 35 U.S.C. 154(b) by 0 days.

(21) Appl. No.: 09/799,511

(22) Filed: Mar. 7, 2001

(51) Int. Cl.[7] ..... A45D 29/00
(52) U.S. Cl. ..... 132/73.6; 15/167.3
(58) Field of Search ..... 132/73.5, 73.6, 132/74.5; 15/167.3, 97.1; D28/56, 57, 58

(56) References Cited

U.S. PATENT DOCUMENTS

| | | | | | |
|---|---|---|---|---|---|
| 2,703,422 | A | | 3/1955 | Roosa | 15/140.2 |
| 2,771,621 | A | * | 11/1956 | Erickson | 15/167.3 |
| 2,922,261 | A | | 1/1960 | Rabkin et al. | 51/170 |
| 3,181,193 | A | | 5/1965 | Nobles et al. | 15/114 |
| 3,392,421 | A | | 7/1968 | Mathison | 15/104.93 |
| 3,712,312 | A | | 1/1973 | Sussman | 132/73.6 |
| 3,918,117 | A | * | 11/1975 | Plante | 15/21 D |
| 4,022,228 | A | | 5/1977 | Ropp et al. | 132/75 |
| 4,117,854 | A | | 10/1978 | Rosenbloom | 132/75.8 |
| 4,282,891 | A | | 8/1981 | Duceppe | 132/73.5 |
| 4,319,596 | A | * | 3/1982 | Jackson | 132/73.6 |
| 4,440,181 | A | | 4/1984 | Scherer | 132/73.5 |
| 4,466,452 | A | | 8/1984 | Ferrari | 132/75 |
| 4,478,232 | A | | 10/1984 | Yasuda | 132/73.6 |
| 4,479,279 | A | * | 10/1984 | Schroeder | 15/159 R |
| 4,510,954 | A | * | 4/1985 | Miller | 132/73.5 |
| 4,800,606 | A | | 1/1989 | Kolesky | 15/97 |
| 5,007,441 | A | | 4/1991 | Goldstein | 132/73.6 |
| 5,023,460 | A | * | 6/1991 | Foster, Jr. et al. | 250/455.1 |
| 5,054,503 | A | | 10/1991 | Keller | 132/73 |
| 5,065,778 | A | | 11/1991 | Terrell | 132/74.5 |
| 5,139,036 | A | | 8/1992 | Pickard | 132/73.5 |
| 5,339,477 | A | | 8/1994 | Warner et al. | 15/97.1 |
| 5,379,474 | A | | 1/1995 | Nakamura | 15/21.1 |
| 5,384,933 | A | * | 1/1995 | Wang | 15/311 |
| D391,025 | S | | 2/1998 | Wolff | D28/58 |
| 5,755,240 | A | * | 5/1998 | Sschonborn | 132/74.5 |
| 5,797,407 | A | * | 8/1998 | Davis et al. | 132/73.6 |
| 5,921,250 | A | * | 7/1999 | Rhea et al. | 132/74.5 |
| 6,035,858 | A | * | 3/2000 | Park | 132/73.5 |
| 6,234,180 | B1 | * | 5/2001 | Davis et al. | 132/74.5 |
| 6,289,900 | B1 | * | 9/2001 | Kay | 132/74.5 |
| 6,389,639 | B1 | * | 5/2002 | Worsham | 15/308 |

FOREIGN PATENT DOCUMENTS

| | | |
|---|---|---|
| DE | 1006829 | 4/1957 |
| GB | 2198334 | 6/1988 |
| IT | 526428 | 5/1955 |

* cited by examiner

*Primary Examiner*—Todd E. Manahan
(74) *Attorney, Agent, or Firm*—Mintz Levin Cohn Ferris Glovsky & Popeo, P.C.

(57) ABSTRACT

A device is disclosed for removing nail polish simultaneously from a plurality of fingernails of a hand or toenails of a foot. The device includes a base having a first area adapted for simultaneously receiving a plurality of fingers of the hand or toes of the foot. Also included in the device is a second area adapted for receiving a single finger of the hand or toe of the foot. A rotatable brush, sponge, or scrubbing member is coupled to the base such that the plurality of fingernails of the hand or toenails of the foot are positionable in contact with the rotatable brush, sponge, or scrubbing member when the plurality of fingers or toes are positioned in the first area or second area. A motor positioned in the base and coupled to the rotatable brush, sponge, or scrubbing member controllably rotates the brush, sponge, or scrubbing member. A hand activated switch on the base actuates an automated motor when the plurality of fingers of the hand or toes of the foot are positioned in the first area of the base to thereby rotate the brush, sponge, or scrubbing member and remove the fingernail polish from the plurality of fingernails or toenails. A hand activated pump or automated motor controllably supplies fingernail polish removing fluid to the brush, sponge, or scrubbing member to aid in removal of the fingernail polish.

57 Claims, 12 Drawing Sheets

AUTOMATED NAIL POLISH REMOVER

BACKGROUND OF THE INVENTION

The present invention relates to nail polish removing devices, and more particularly, to a device for use by manicurists or their customers for automatically applying a nail polish removing fluid to a user's fingernails or toenails in a controlled manner, while at the same time subjecting the nails to a scrubbing action. The present invention includes features which facilitate clean-up of the nail polish remover and which increase the ease of use of the device as compared to prior art nail polish removers.

One method in widespread use of removing nail polish from fingernails or toenails involves a person wetting a piece of cotton with nail polish removing fluid and then rubbing the fingernails or toenails with the wetted cotton until the nail polish has been removed. In addition to being overly time consuming, this commonly used method presents the high probability that nail polish removing fluid will be inadvertently dripped or spilled onto clothing, carpets or furniture. Further, this method typically requires that nail polish be removed from only one fingernail or toenail at a time, further lengthening the process.

A number of automatic fingernail polish removing devices are known in the art. These devices typically have a rotating scrubbing member, such as a brush, which sits partially immersed in a reservoir of fingernail polish removing fluid. One or more of the fingernails of the user's hand are placed in contact with the rotating scrubbing member in order to remove the fingernail polish from the fingernails with the help of a fingernail polish removing fluid. One disadvantage of these prior art fingernail polish removing devices is that a large amount of the fingernail polish remover, in which the scrubbing member is partially immersed, is wasted. Another disadvantage is that the rotating scrubbing member is difficult to clean or replace. Yet another disadvantage is that disposal of used fingernail polish removing fluid is frequently a cumbersome and messy task. Additionally, because disposal of used fingernail polish removing fluid is a cumbersome and messy task, a user is less apt to frequently change the solution resulting in unsanitary fingernail polish remover. A further disadvantage is that devices known in the art are typically limited to cleaning fingernails of the hand and are not also capable of cleaning toenails of the foot. Additionally, devices known in the art lack a method for cleaning a single fingernail or toenail while simultaneously protecting the other fingernails or toenails.

Therefore, there is a need for an improved nail polish removing device which can be used to remove fingernail polish from the fingernails of a user's hand or toenails of a user's foot in a safe, clean and efficient manner without wasting nail polish removing fluid. Additionally, there is a need for an improved nail polish removing device which provides fresh nail polish removing fluid to the scrubbing unit thereby providing sanitary conditions for the user. Further, there is need for an improved nail polish removing device which can clean the nails of both fingers and toes. Additionally, there is a need for an improved nail polish removing device which can clean a single fingernail or toenail while simultaneously protecting the other fingernails or toenails.

SUMMARY OF THE INVENTION

A device is disclosed for removing nail polish simultaneously from a plurality of fingernails of a hand or toenails of a foot. The device includes a base having a first area adapted for simultaneously receiving a plurality of fingers of the hand or toes of the foot. Also included in the device is a second area adapted for receiving a single finger of the hand or toe of the foot. A rotatable brush, sponge, or scrubbing member is coupled to the base such that the plurality of fingernails of the hand or toenails of the foot are positionable in contact with the rotatable brush, sponge, or scrubbing member when the plurality of fingers or toes are positioned in the first area. The rotatable brush, sponge, or scrubbing member is also positioned so that a single fingernail of the hand or toenail of the foot is in contact with the rotatable brush, sponge, or scrubbing member when inserted in the second area. A motor positioned in the base and coupled to the rotatable brush, sponge, or scrubbing member controllably rotates the brush, sponge, or scrubbing member. A palm or foot-sole activated switch on the base actuates an automated motor when the plurality of fingers of the hand or toes of the foot are positioned in the first area of the base to thereby rotate the brush, sponge, or scrubbing member and remove the nail polish from the plurality of fingernails or toenails. A hand activated pump or automated motor controllably supplies nail polish removing fluid to the brush, sponge, or scrubbing member to aid in removal of the nail polish.

In some preferred embodiments of the present invention, the hand activated pump or automated motor supplies nail polish removing fluid to the brush, sponge, or scrubbing member from a reservoir which can be removed from the base for refilling or to facilitate ease of storage of the device. In some preferred embodiments of the nail polish removing device of the present invention, the hand activated pump or automated motor includes a downwardly extending nozzle which moves toward the rotatable brush, sponge, or scrubbing member during engagement of the hand activated pump or automated motor such that nail polish removing fluid is delivered in close proximity to the brush, sponge, or scrubbing member.

In some preferred embodiments, the nail polish removing device includes a removable drain pan below the first area for collecting nail polish removing fluid runoff from the rotatable brush, sponge, or scrubbing member. The removable drain pan can be conveniently removed for disposal of the collected nail polish removing fluid. In some preferred embodiments, the device of the present invention includes a cleaning member which is movably coupled to the base and selectively moveable into contact with the rotatable brush, sponge, or scrubbing member while the rotatable brush, sponge, or scrubbing member rotates, in order to clean the rotatable brush, sponge, or scrubbing member after use.

DETAILED DESCRIPTION OF THE PREFERRED EMBODIMENTS

Figure 1:
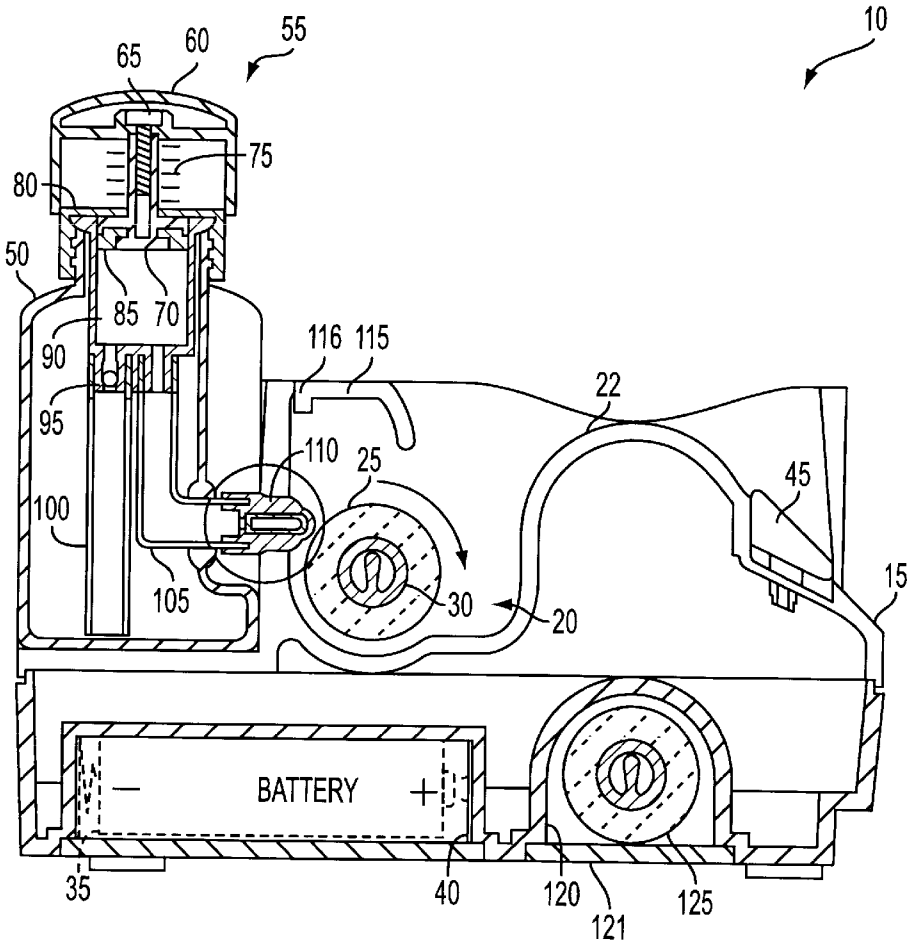
FIG. 1 is a diagrammatic side view, with portions shown in section, of a nail polish removing device in accordance with first preferred embodiments of the present invention.

FIG. 1 is a diagrammatic side view, with portions shown in section, of nail polish removing device 10 in accordance with some preferred embodiments of the present invention.

As illustrated in FIG. 1, device 10 includes base or housing 15 which has finger or toe receiving area formed therein. As is illustrated in greater detail in FIG. 5, base 15 also has a raised portion formed therein for supporting the area under the knuckles of a user's hand or sole of a user's foot while the fingers of the hand or toes of the foot are inserted into area 20. Device 10 also includes generally cylindrical sponge or scrubbing member 25 which rotates on cartridge housing 30. In other embodiments, scrubbing member 25 can be a brush or other similarly suited rotating scrubbing device.

Battery 35 is positioned in battery compartment 40 formed in base 15. Battery 35 provides one of several possible sources of electrical energy needed to power an automated motor of device 10. As discussed below with reference to FIG. 4, device 10 can alternatively be controlled to operate from a 120 volt or 240 volt AC power source. To control the supply of energy to the automated motor of device 10, switch 45 is included on base 15. The switch 45 is preferably in a position chosen such that it can be actuated by the palm of the user's hand or sole of the user's foot while the fingers of the hand or toes of the foot are inserted into area 20.

Device 10 also includes container or reservoir 50 which holds a supply of nail polish removing fluid. Container 50 maintains the supply of nail polish removing fluid separate from area 20 of base 15 and from sponge or member 25. Pump 55 of device 10 is used to controllably and selectively deliver nail polish removing fluid to sponge 25 to aid in the removal of nail polish from the fingernails of a user's hand or toes of a user's foot, while reducing or minimizing the waste of nail polish removing fluid common in some prior art devices.

Pump 55 includes outside cap 60, screw 65, compression cylinder 70, spring 75, inside cap 80, seal 85, compression tube 90, ball valve 95, first tube 100, second tube 105 and shooter 110. Outside cap 60 is connected to compression cylinder 70 by screw 65. Spring 75 is positioned between outside cap 60 and inside cap 80 so that outside cap 60 and compression cylinder 70 are biased in a non-compressed position. Seal 85 helps to provide an airtight configuration in which compression cylinder 70 can be forced downward into compression tube 90 as manual force is applied to outer cap 60, and in which compression cylinder 70 can be forced upward within compression tube 90 as spring 75 moves outside cap 60 and compression cylinder 70 back toward their resting positions. Compression tube 90 is in fluid communication with container 50 through ball valve 95 and first tube 100. Compression tube 90 is in selective fluid communication with sponge 25 using second tube 105 and shooter or spraying device 110. Thus, the fluid path from container 50, through pump 55, to sponge 25 is controllable in a manually actuated manner to prevent the inefficient use or waste of nail polish removing fluid. The configuration of device 10 allows the user to manually control the application of nail polish removing fluid with one hand or foot, while removing nail polish from the other hand or foot. It should be noted that in other embodiments manual pump 55 can be replaced with an electric or otherwise automated pump to achieve the same objective.

Figure 2:
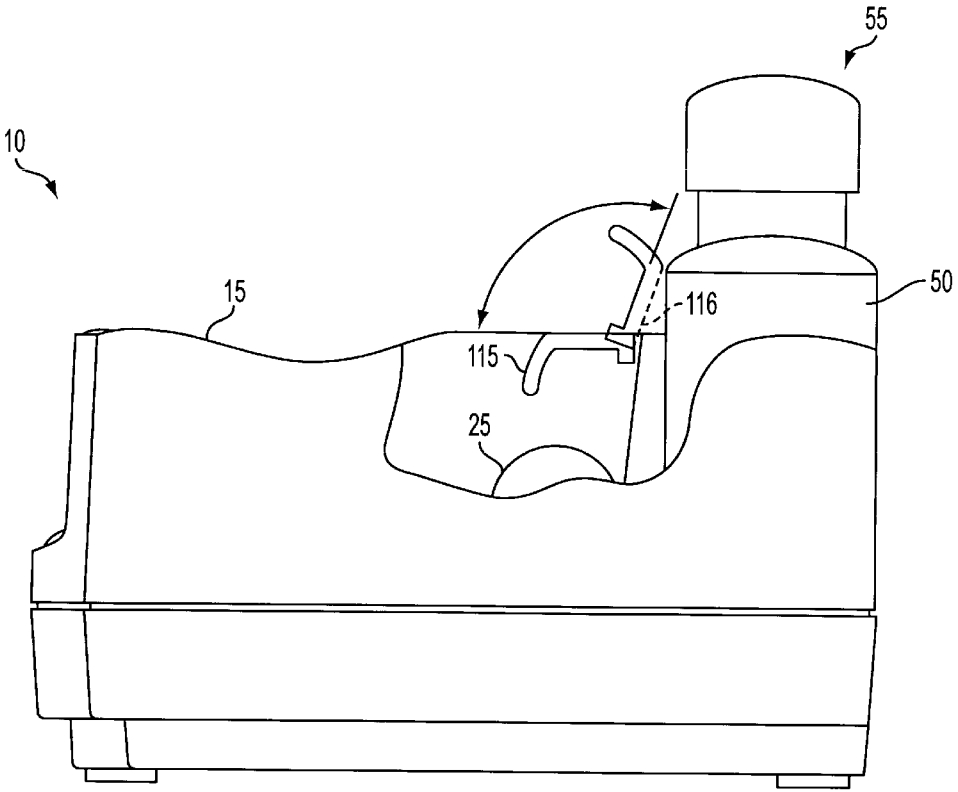
FIG. 2 is a diagrammatic side view of the nail polish removing device illustrated in FIG. 1, which further illustrates a movable lid feature of the present invention which allows cleaning or replacement of the rotatable scrubbing member.

Lid 115, which is coupled in a movable fashion to base 15 using pin 116, prevents nail polish removing fluid from being sprayed or expelled from area 20 by the rotational movement of sponge 25. As illustrated in FIG. 2, lid 115 is rotatably hinged to its base 15 by pin 116 such that it can be moved to an open position. As will be discussed later with reference to FIG. 3, with lid 115 in the open position, sponge 25 can be removed from base 15 for cleaning or for replacement. To this end, device 10 includes storage compartment 120 (illustrated in FIG. 1) having lid 121 for storing a replacement sponge 125.

Figure 3:
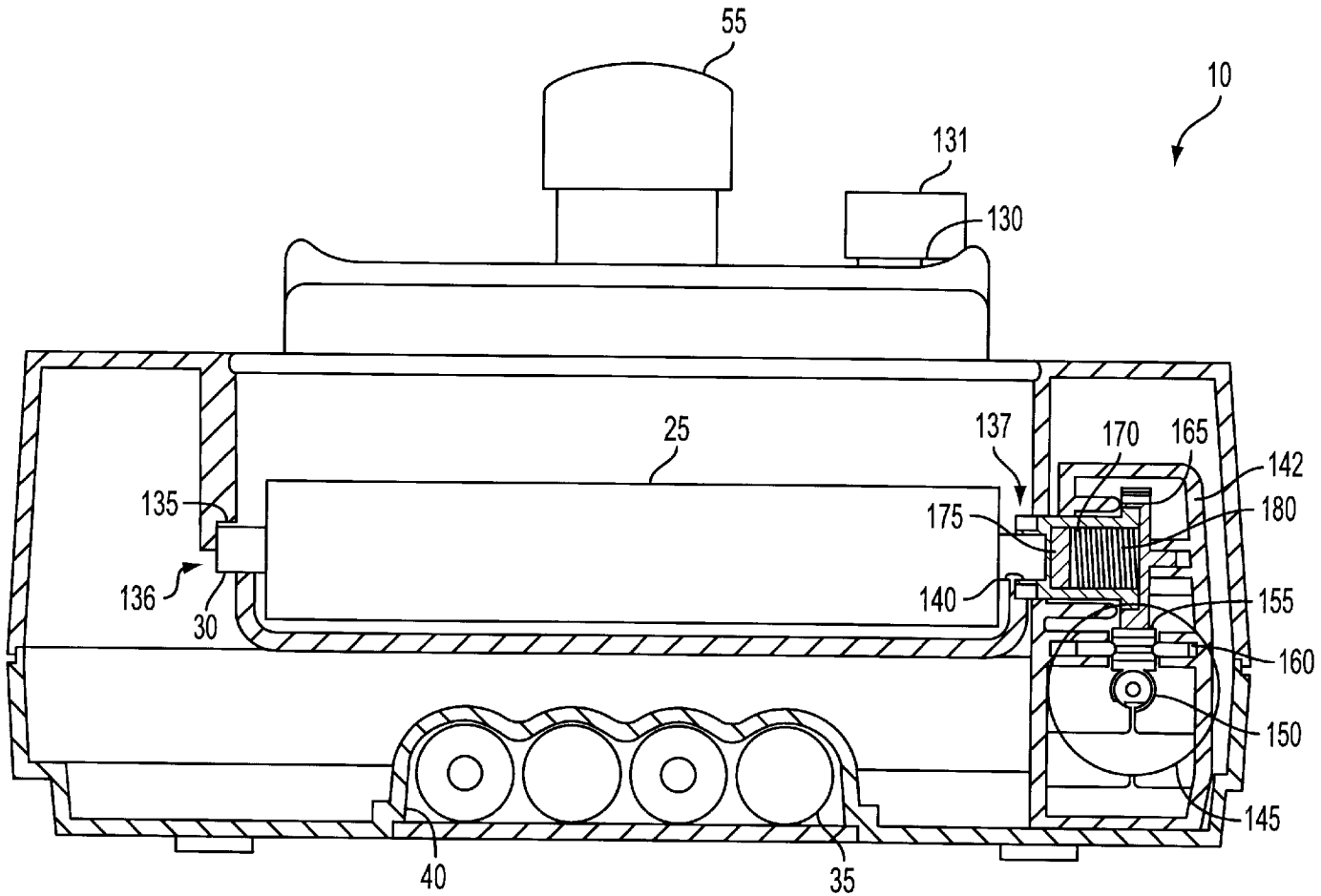
FIG. 3 is a rear view of the nail polish removing device illustrated in FIG. 1 and FIG. 2, which further illustrates a gear configuration adapted for allowing the scrubbing member to be removed for cleaning or replacement.

FIG. 3 is a diagrammatic rear view, with portions shown in section, which further illustrates advantageous features of nail polish removing device 10 of the present invention. As illustrated in FIG. 3, device 10 includes opening 130 to container 50, and lid 131 for covering opening 130. Thus, container 50 can be easily refilled with nail polish removing fluid in a clean, efficient fashion. Also, as illustrated in FIG. 3, device 10 includes cartridge receiving apertures 135 and 140 adapted for receiving first end 136 and second end 137 of cartridge housing 30.

Device 10 also includes gear box 142, which in turn contains motor 145 and a gear configuration adapted for allowing sponge 25 to be easily removed for cleaning or replacement. Motor 145 is coupled to worm gear 150 for causing rotation of worm gear 150. Worm gear 150 is coupled to pinion gear 155, which rotates on shaft 160 in response to the rotation of worm gear 150. Pinion gear 155 is coupled to output gear 165. Output gear 165 is coupled to output gear adapter 170 such that output gear 165 and output gear adapter 170 rotate in unison in response to rotation of pinion gear 155. Compression plate 175 is positioned within output gear adapter 170. Spring 180 is positioned within output gear adapter 170, between compression plate 175 and output gear 165. Thus, in normal operation, spring 180 provides a biasing force against compression plate 175 which maintains compression plate 175 in contact with second end 137 of cartridge housing 30. In this manner, when motor 145 is actuated or engaged by compression of switch 45 (illustrated in FIG. 1) during normal operation of device 10, rotational movement of the gears causes rotational movement of compression plate 175, and thus of cartridge housing 30 and sponge 25. However, with lid 115 (illustrated in FIG. 1 and FIG. 2) in an open position, sponge 25 can be removed from finger receiving area 20 by sliding sponge 25 and cartridge housing 30 in a longitudinal direction toward compression plate 175. When spring 180 is sufficiently compressed, first end 136 of cartridge housing 30 clears aperture 135 such that sponge 25 can be removed.

Figure 4:
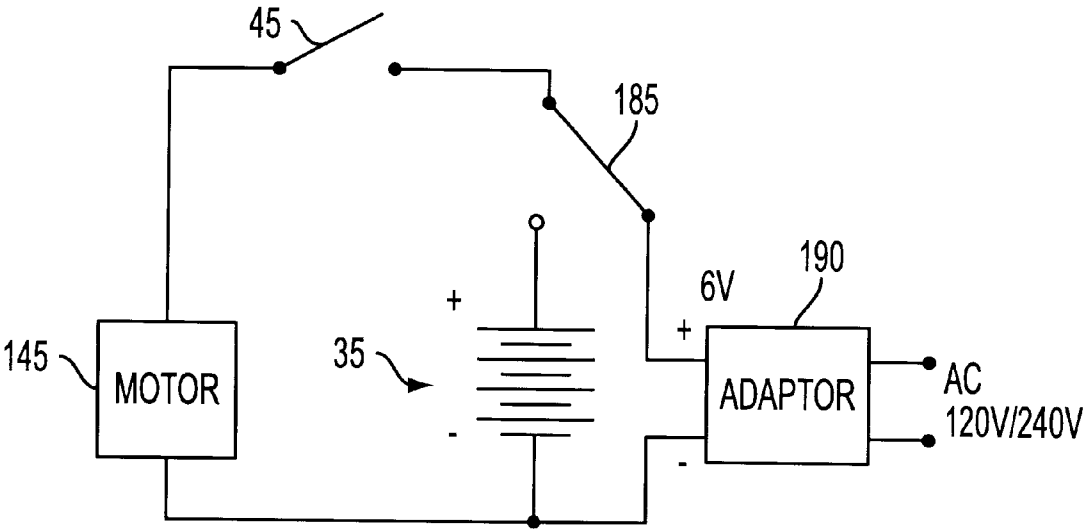
FIG. 4 is a circuit diagram illustrating the various sources of electrical energy which can be used to power an automated motor of the nail polish removing device of the present invention.

FIG. 4 is a circuit diagram illustrating the various sources of electrical energy which can be used to power the nail polish removing device 10 of the present invention. As illustrated in the electrical circuit of FIG. 4, switch 185 can be moved between two positions. As illustrated in the first position, switch 185 couples a DC source of power provided by AC to DC adapter 190 to the rest of the circuit. In this manner, device 10 of the present invention can be powered using either a 120 volt AC power source or a 240 volt AC power source. Adapters such as adapter 190 for providing a substantially constant DC power supply (6 volts, as illustrated) from either a 120 volt AC power supply or a 240 volt AC power supply are well-known in the art. In the second position of switch 185, battery 35 provides a DC power source for powering device 10. Also as illustrated in FIG. 4, palm or sole actuated switch 45 is biased in a normally open position such that motor 145 receives electrical power only when switch 45 is depressed by the palm of the user's hand or the sole of the user's foot.

Figure 5:
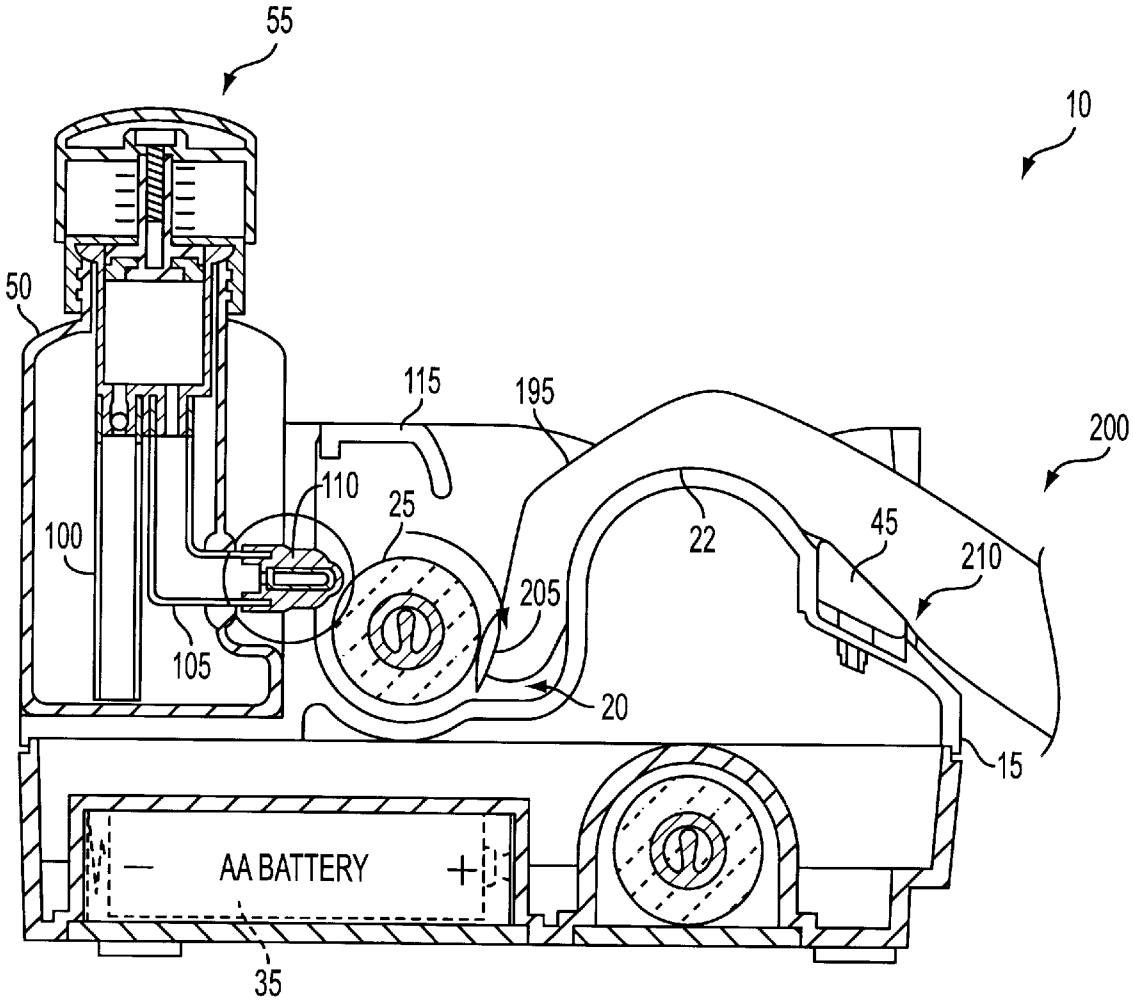
FIG. 5 is a diagrammatic side view, with portions shown in section, of the nail polish removing device illustrated in FIG. 1, which further illustrates the manner in which nail polish is removed from the fingernails of a customer's hand.

FIG. 5 is a diagrammatic side view, with portions shown in section, which illustrates operation of device 10 of the present invention in greater detail. As illustrated, fingers 195 of hand 200 of a user have been inserted into area 20 of base 15. Raised portion 22 of base 15 supports the user's hand in this position. In this position, fingernails 205 on fingers 195 are positioned adjacent to sponge or scrubbing member 25. Thus, in this position, fingernails 205 are either in contact with sponge 25, or are positioned such that they can be easily placed in contact with sponge 25. Also in this position, palm 210 of hand 200 can be used to depress or actuate switch 45. Thus, motor 145 can be easily controlled to rotate sponge 25 primarily only when hand 200 of the user is in the proper position. This provides increased energy efficiency which will prolong the useful life of batteries 35. Further, with the user able to control motor 145 using only the hand from which the nail polish is to be removed, the user's other hand can be employed to manually pump nail polish removing fluid from container 50 using pump 55. This provides an additional advantage over conventional nail polish removing devices in that the user can control the amount of nail polish removing fluid used in order to minimize waste. With a user controlled quantity of nail polish removing fluid applied to sponge 25, nail polish is efficiently, conveniently and cleanly removed from the nails of hand 200.

Figure 6:
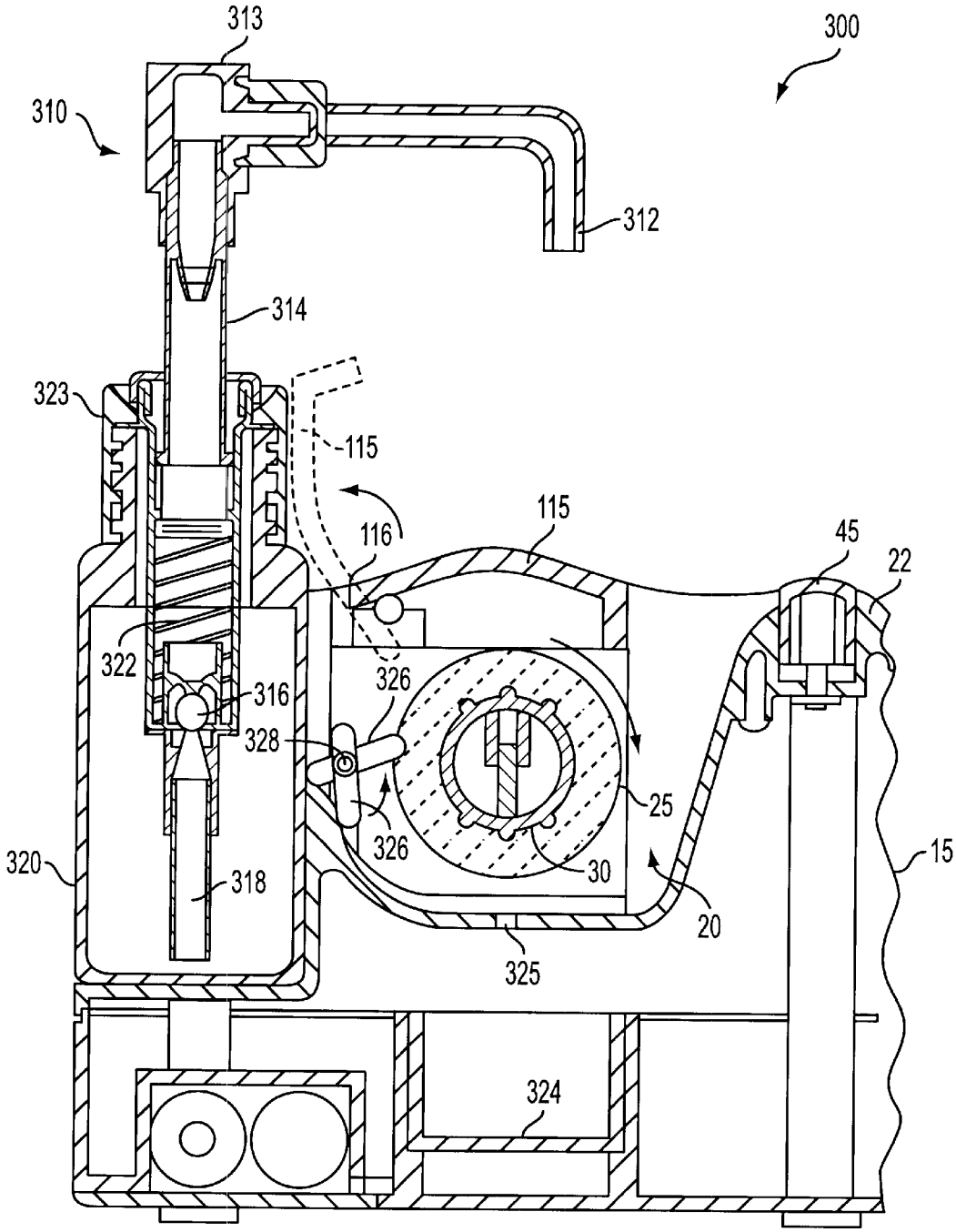
FIG. 6 is a diagrammatic side view, with portions shown in section, of a nail polish removing device in accordance with a second preferred embodiment of the present invention.

FIG. 6 is a diagrammatic side view, with portions shown in section, of nail polish removing device 300 in accordance with alternate preferred embodiment of the present invention. Except as discussed below, device 300 contains substantially the same components and functions in substantially the same manner as device 10 shown in FIG. 1. Device 300 differs from device 10 in that it includes a number of additional or altered features to facilitate ease of use or clean-up of the device 300.

Like device 10, device 300 includes base or housing 15 having finger receiving area 20 formed therein. Device 300 also includes generally cylindrical sponge or scrubbing member 25 which rotates on cartridge housing 30. Rotation of sponge 25 is facilitated by motor 145 (not shown in FIG. 6) as was the case with device 10. Further, each of devices 10 and 300 include lid 115, which is coupled in a moveable fashion to base 15 using pin 116 to prevent nail polish removing fluid from being sprayed or expelled from area 20 by rotational movement of sponge 25.

Device 300 differs from device 10 in the following respects. First, the general shape of raised portion 22 formed in base 15 is altered to better support the underside of a user's hand while the fingers of the hand are inserted into area 20 in a manner similar to that shown in FIG. 5. Further, switch 45 is moved from its position in device 10 under the portion of the palm of the user's hand near the user's wrist, to a location at or near the peak of raised portion 22 such that switch 45 is located in closer proximity to the knuckles of the user's hand. Also, as is better seen in FIG. 8, switch 45 is curved along the width of device 300 in order to comfortably and ergonomically fit with the user's hand.

An additional difference between device 300 and device 10 is that pump 55 is replaced with alternate pump design 310. Pump 310 includes downwardly extending nozzle 312 which extends downward toward sponge 25, compressor 313, tube 314, ball valve 316, tube 318, container or reservoir 320, spring loading mechanism 322 and cap 323. Pump 310 functions generally as follows. Upon applying a downward force with a second hand on compressor 313, fluid in tube 314 is forced or expelled out of pump 310 from nozzle 312. Because nozzle 312 moves downward toward sponge 25 when a user's hand forces compressor 313 downward, nozzle 312 places the nail polish removing fluid in close proximity to sponge 25, thus minimizing mess and waste of nail polish removing fluid. Further, nozzle 312, compressor 313 and tube 314 can be rotated within reservoir 320 about a longitudinal axis (axis 329 shown in FIG. 7) such that nozzle 312 can be selectively directed toward a specific end or middle location of sponge 25. Of course, while pump or automated motor 310 is used to deliver nail polish removing fluid to sponge 25, lid 115 is in the up or open position illustrated in FIG. 6 by dashed lines.

When compressor 313 is allowed to move upward with the help of biasing spring 322, ball valve 316 allows nail polish removing fluid from reservoir 320 to be moved through tube 318 and into tube 314. Thus, nail polish removing fluid is available in tube 314 for the next utilization of pump 310. Pump 310 also includes cap 323 to reservoir 320, which can be removed in order to refill reservoir 320. Further, cap 323 can be removed along with its cooperating components 312, 313, 314, 316, 318 and 322, and replaced with a solid cap. Thus, after these components of pump 310 have been removed from reservoir 320, the reservoir can be tightly sealed for storage or travel.

A further advantageous feature of device 300 is that reservoir or container 320 is coupled to base 15 during use, but can be slid out of the base 15 or otherwise removed from base 15 for refilling, storage or travel. This feature is best illustrated in FIG. 7 which shows reservoir 320 fitting within, but having slightly different shape and dimensions than, the cooperating portion of base 15.

Another advantageous feature of device 300 relates to cleaning device or member 326. Member 326 is rotatably coupled to base 15 by pin or rod 328. While device 300 is used to remove nail polish from the fingers of the user's hand, cleaning member 326 is maintained in a position away from sponge 25. When device 300 is not in use for removing nail polish from a user's hand, and when sponge 25 is in need of cleaning, cleaning member 326 is rotated about pin 328 into contact with sponge 25 as sponge 25 rotates. Thus, cleaning member 326 provides a squeezing, scrapping or squeegeeing function for cleaning sponge 25. Knob 330 (shown in FIG. 7) is used to rotate cleaning member 326.

Another advantageous feature of device 300 is that it includes removable drain pan or reservoir 324 for collecting nail polish removing fluid runoff from sponge 25. Nail polish removing fluid runoff from sponge 25 flows through drain holes or apertures 325 into drain pan 324 during use. After using device 300 to remove nail polish from the nails of a user's hand, drain pan 324 can be slid out of the base 15 or otherwise removed in order to dispose of the used nail polish removing fluid. This feature is further illustrated in FIG. 11.

Figure 7:
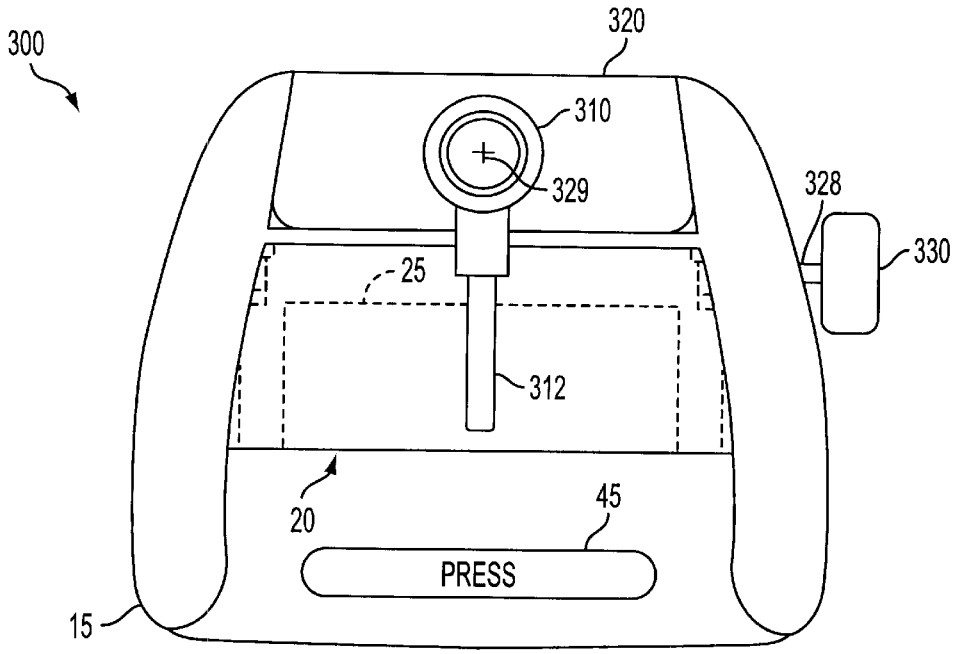
FIG. 7 is a top view of the nail polish removing device illustrated in FIG. 6, which further illustrates advantageous features of the present invention.

FIG. 7 is a top view of device 300 which further illustrates the advantageous features of the present invention. As can be clearly seen in FIG. 7, switch 45 is located in close proximity to area 20. Further, nozzle 312 is positioned directly over area 20 and sponge 25. Also, nozzle 312 of pump 310 can be pivoted about axis 329 to tailor the delivery of nail polish removing fluid to specific locations of sponge 25.

As can be seen in FIG. 7, container or reservoir 320 has dimensions and a shape which are adapted to enable reservoir 320 to be lifted upward and away from base 15 for refilling, storage or travel. Also illustrated in FIG. 7 is knob 330 coupled to pin or rod 328, and thereby to cleaning member 326 (shown in FIG. 6). In order to engage or disengage cleaning member 326 from sponge 25, knob 330 is rotated in the corresponding clockwise or counterclockwise direction.

Figure 8:
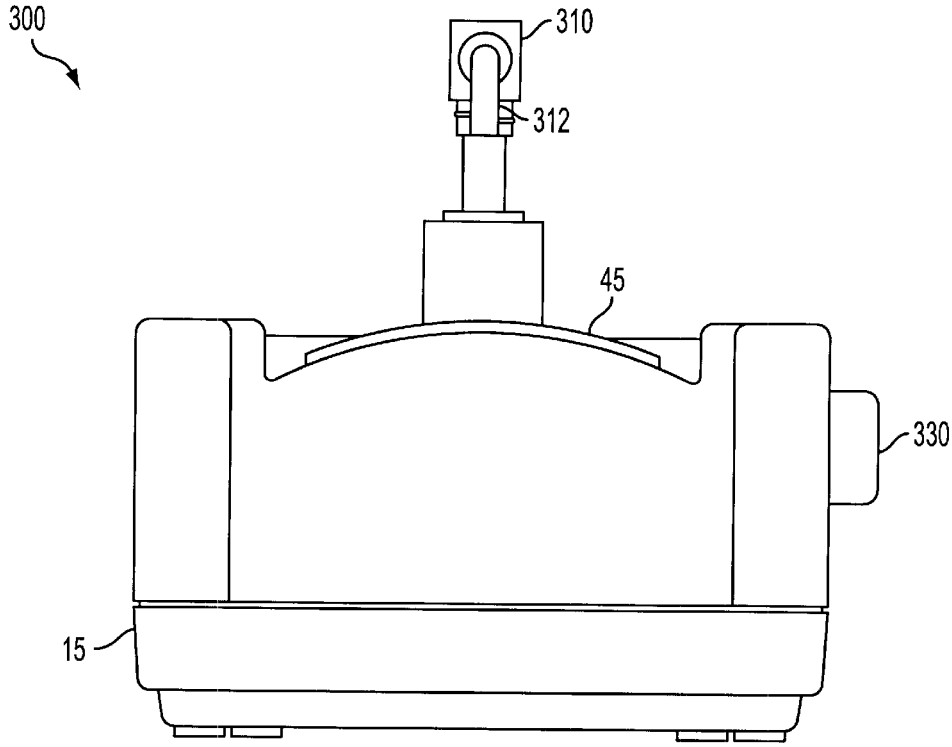
FIG. 8 is a front view of the nail polish removing device illustrated in FIG. 6, which further illustrates advantageous features of the present invention.

FIG. 8 is a front view which further illustrates the advantageous features of device 300 of the present invention. As shown in FIG. 8, switch 45 has a curved shape adapted for comfortable cooperation with the underside of a user's hand. Also shown in FIG. 8 are knob 330 for engaging and disengaging cleaning member 326, and downwardly extending nozzle 312 of pump 310 for delivering nail polish removing fluid to sponge 25 in a clean and controlled manner.

Figure 9:
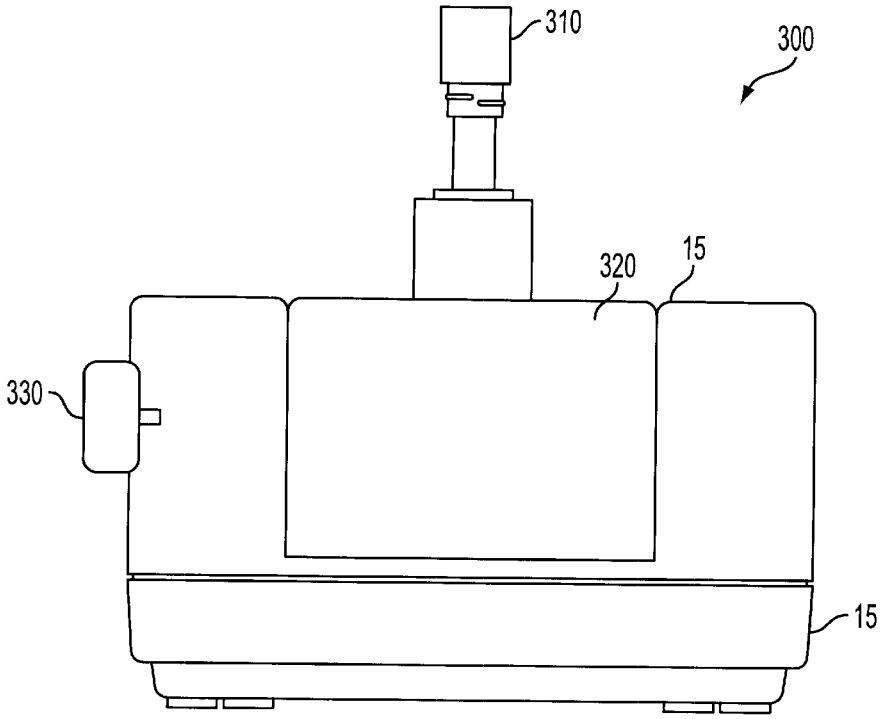
FIG. 9 is a rear view of the nail polish removing device illustrated in FIG. 6, which further illustrates advantageous features of the present invention.
Figure 10:
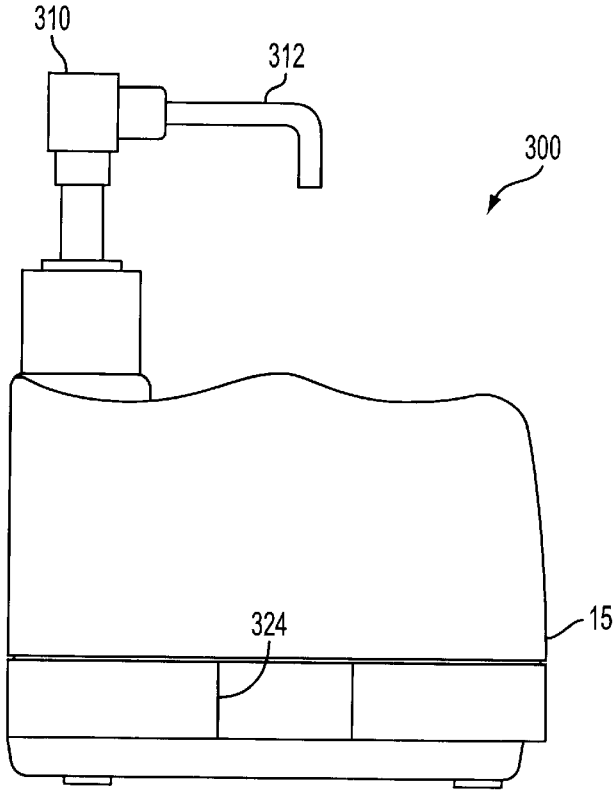
FIG. 10 is a side view of the nail polish removing device illustrated in FIG. 6, which further illustrates advantageous features of the present invention.
Figure 11:
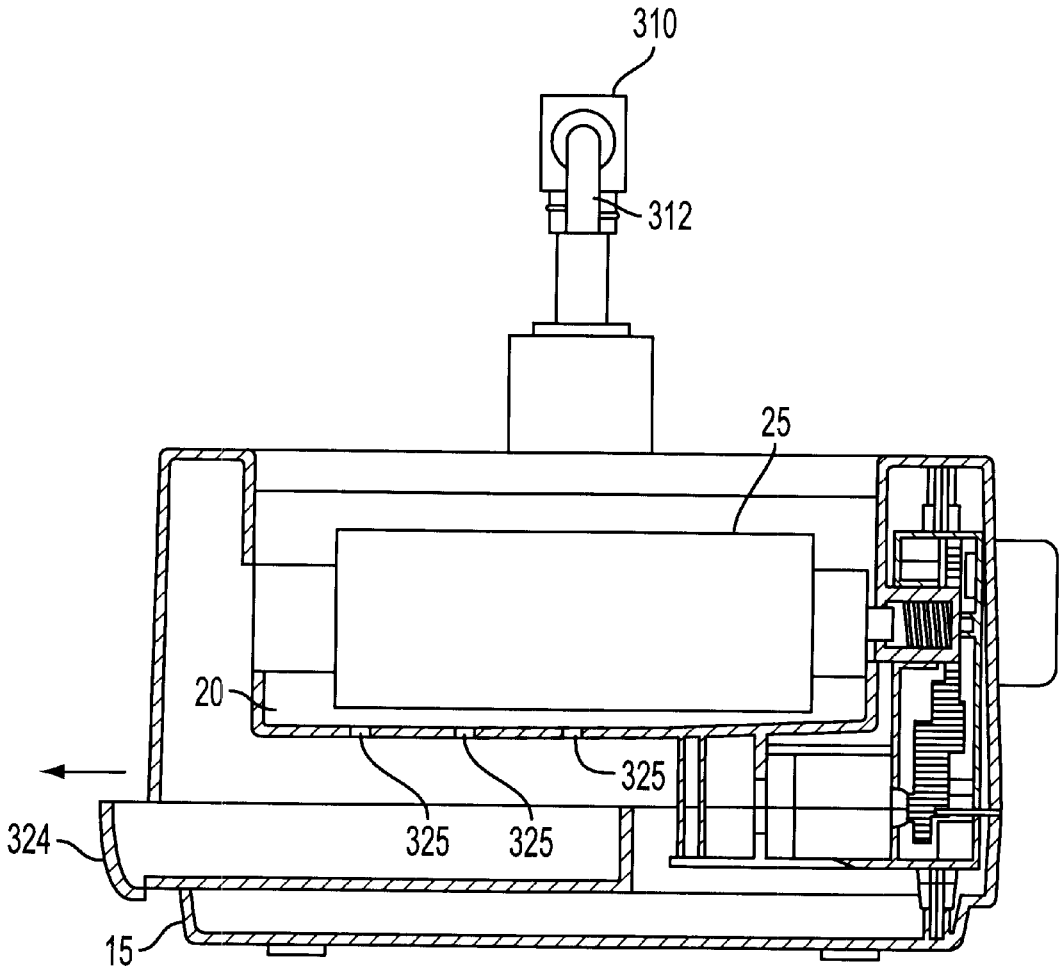
FIG. 11 is a diagrammatic front view, with portions shown in section, of the nail polish removing device shown in FIG. 6, and which further illustrates advantageous features of the present invention.

FIG. 9 is a rear view of device 300 which illustrates the shape of reservoir 320 and base 15 which allows reservoir 320 to be lifted upward out of contact with base 15 when desired. FIG. 10 is a side view which illustrates removable drain pan 324 of base 15 for collecting nail polish removing fluid runoff from nozzle 312 and from sponge 25. Operation of drain pan 324 is better shown in FIG. 11. As shown in FIG. 11, base 15 includes drain holes 325 positioned under area 20 and sponge 25 for draining nail polish removing fluid runoff into drain pan 324. Drain pan 324 can be slid in the direction of the arrow in order to remove drain pan 324 from base 15. In this manner, nail polish removing fluid runoff can be disposed of in a clean and convenient manner.

Figure 12:
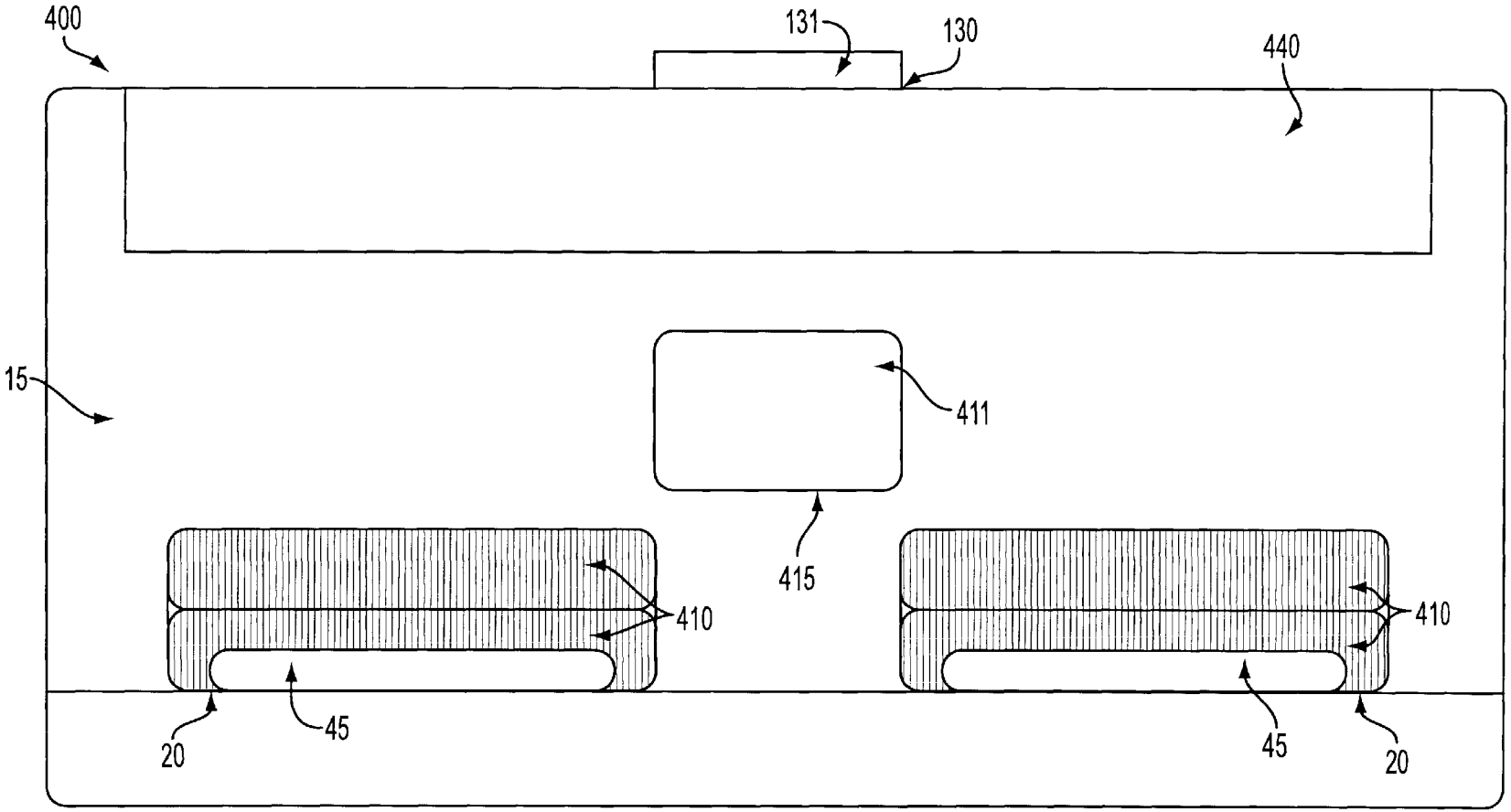
FIG. 12 is a front view of a nail polish removing device in accordance with a third preferred embodiment of the present invention.

FIG. 12 is a front view of a nail polish removing device 400 in accordance with a third preferred embodiment of the present invention. Device 400 differs from device 10 and device 300 in that it includes a number of additional or altered features to facilitate removing nail polish from both a user's toenails and fingernails. Device 400 also replaces the hand activated pump from device 10 and device 300 with an electric or otherwise automated pump (not shown in FIG. 12).

As illustrated in FIG. 12, device 400 includes a base or housing 15 which has two areas for receiving a plurality of fingers or toes 20 and an area for receiving a single finger or toe 415. Hands or feet may be inserted into either a single area 20 or both areas 20 and positioned adjacent to a generally cylindrical brush, sponge or scrubbing member 25 (shown in FIG. 13). In this position, the fingernails or toenails of the inserted hands or feet are either in contact with scrubbing member 25 or are positioned such that they can be easily placed in contact with scrubbing member 25. Switches 45 are positioned at the entrance of areas 20 so that the switches 45 may be depressed or actuated by the inserted hand or foot of a user to operate a motor 145 (not shown in FIG. 12) which rotates the scrubbing member 25 in substantially the same method and manner as the corresponding motors illustrated in device 10 and device 300. While the device 400 is illustrated in FIG. 12 with two areas 20, in an alternate preferred embodiment the device 400 comprises a single area 20 and an area 415.

Single fingers or toes may be inserted into area 415 and positioned adjacent to scrubbing member 25 for cleaning. In a preferred embodiment, a finger or toe may be inserted into area 415 shortly after nail polish has been applied or while the manicure is still wet. Thus, such an embodiment has the advantage of allowing a user to clean nail polish from a fingernail or toenail that has a damaged or smudged nail polish application while not disturbing the nail polish application of the other fingers or toes.

An advantage of device 400 is the prevention of spraying and expulsion of nail polish removing fluid from areas 20 and area 415 by the rotational movement of scrubbing member 25. Spray prevention shields 410 extend from the top and bottom surfaces of the entrances of areas 20 allowing the insertion of fingers or toes but preventing the spraying or expulsion of nail polish removing fluid. Preferably, the spray prevention shields 410 are combs of soft bristles. Spray barrier 411 covers the entrance of area 415 allowing the insertion of a finger or toe but preventing the spraying or expulsion of nail polish removing fluid. Preferably, the spray barrier 411 is a spring loaded door. In a preferred embodiment, the spray barrier 411 is normally in a closed position. The spray barrier 411 moves to an open position when a user's finger or toe pushes the spray barrier 411 inward. Upon removal of the finger or toe, the spray barrier 411 returns to a closed position. In a further preferred embodiment, the spray barrier 411 is comprised of the same material as the base 15.

In a further preferred embodiment of the present invention, the interior of the base 15 containing the scrubbing member 25 further comprises a sanitizing element. This sanitizing element sterilizes the scrubbing member 25 and the interior of the base 15 containing the scrubbing member 25. In a preferred embodiment, the sanitizing element is an ultraviolet light or lamp. When illuminated, the ultraviolet light or lamp incapacitates and sterilizes any bacteria or fungus on the scrubbing member 25 or in the interior of the base 15. In one embodiment, the ultraviolet light is illuminated when the device 400 is in use. In a preferred embodiment, the ultraviolet light is illuminated when the device 400 is not in use by a user. In one embodiment, the ultraviolet light is illuminated by a manual switch which is actuated by a user. In a more preferred embodiment, the ultraviolet light is automatically illuminated when the device 400 is not in use. This automatic illumination may occur following the release of switch 45 by a user or at predetermined time intervals during the inactivity of device 400. The ultraviolet light may remain on constantly during use and nonuse of device 400. However, in a preferred embodiment, the ultraviolet light is automatically illuminated when a user's fingers or toes are removed from areas 20 or area 411 and remains illuminated for a predetermined period of time to sufficiently sterilize the interior of base 15 and the scrubbing member 25.

In another embodiment of the present invention, the sanitizing element may be a means for applying a sterilizing fluid or solution to the scrubbing member 25 and the interior of the base 15. This means may be a spray nozzle that sanitizes the scrubbing member 25 and the interior of the base 15 with an atomized mist or droplets of a sterilizing fluid or solution. Preferably, the sterilizing fluid is stored in a reservoir separate from container 50. The means may comprise a pump or distribution mechanism for delivering the sterilizing fluid or solution from the reservoir to the spray nozzle. In an embodiment of the present invention, the sterilizing fluid is delivered to the interior of the base 15 and the scrubbing member 25 when the device 400 is in use. In a preferred embodiment, the sterilizing fluid is delivered when the device 400 is not in use by the user. In one embodiment of the present invention, the means for applying the sterilizing fluid or solution is manually actuated by the user. In a more preferred embodiment, the means is automatically actuated when the device 400 is not in use. This automatic actuation may occur following the release of switch 45 by a user or at predetermined time intervals during the inactivity of device 400. The sterilizing fluid may be regularly delivered to the scrubbing member 25 and the interior of the base 15 during the use and nonuse of device 400. In a further preferred embodiment of the present invention, the means for applying the sterilizing fluid is automatically actuated when a user's fingers or toes are removed from areas 20 or area 411 and remains actuated for a predetermined period of time to sufficiently sterilize the interior of the base 15 and the scrubbing member 25.

Figure 13:
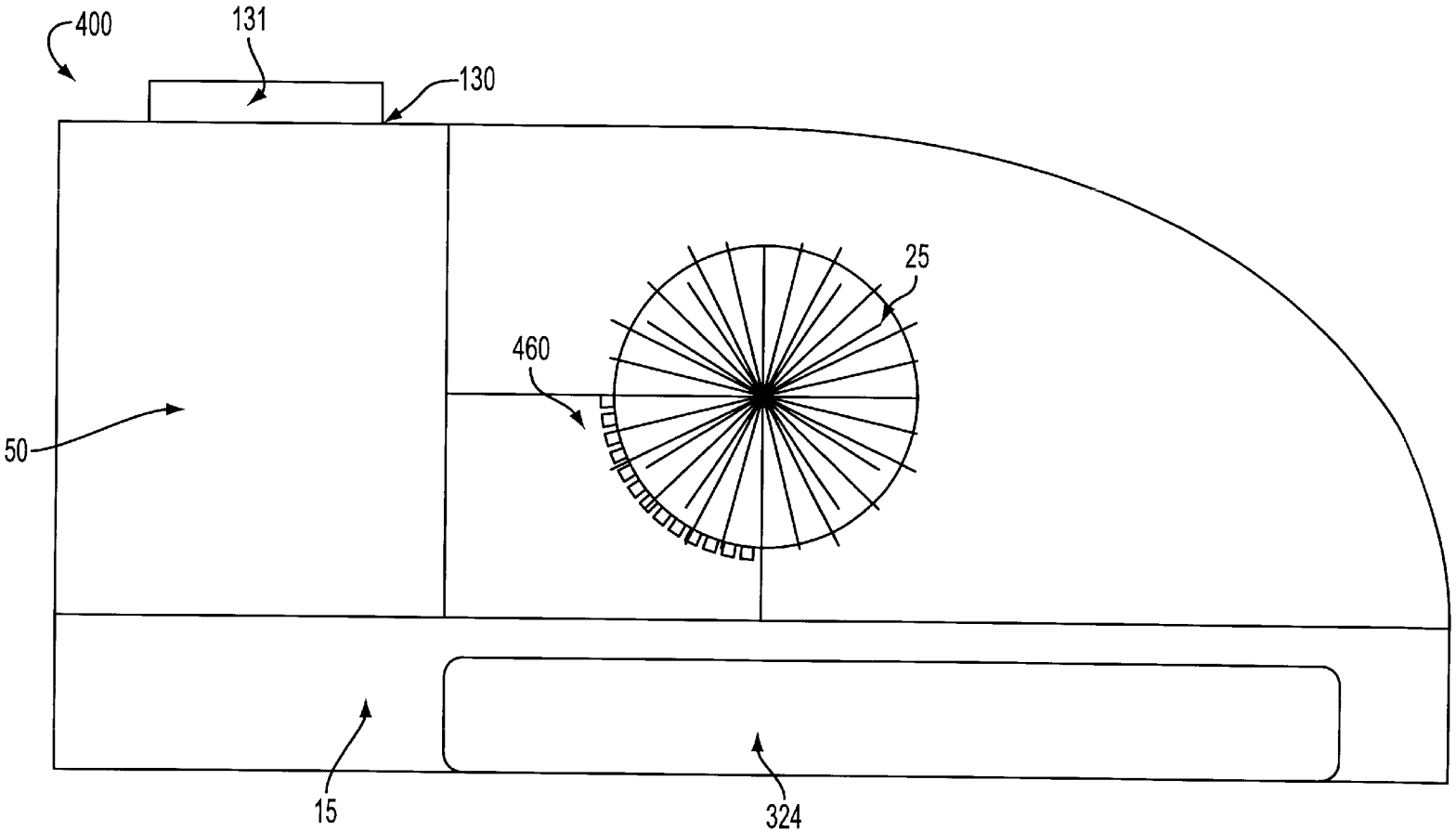
FIG. 13 is a side view, with portions shown in section, of the nail polish removing device illustrated in FIG. 12, which further illustrates advantageous features of the present invention.

FIG. 13 is a side view, with portions shown in section, of the nail polish removing device 400 illustrated in FIG. 12, which further illustrates advantageous features of the present invention.

As illustrated in FIG. 13, device 400 includes a base or housing 15. This base 15 includes a removable drain pan or reservoir 324 for collecting nail polish fluid runoff from scrubbing member 25. Drain pan 324 may be pulled or slid out of base 15 to remove drain pan 324 from base 15 to conveniently dispose of nail polish removing fluid runoff.

As in device 10 and device 300, device 400 includes a container or reservoir 50 which holds a supply of nail polish removing fluid. Container 50 includes opening 130 for refilling container 50 with nail polish removing fluid, as well as lid 131 for cover opening 130. While container 50 is coupled or housed in base 15 during use of device 400, container 50 may be removed from base 15. Such removal allows for the convenient refilling of container 50. Further, removal of container 50 from base 15 may allow a user to more easily stow device 400 for storage or travel. In a preferred embodiment, container 50 has a unique shape that fits into a corresponding coupling or housing in base 15.

As illustrated in FIG. 13, device 400 contains a generally cylindrical brush, sponge or scrubbing member 25. Scrubbing member 25 is controllably rotated by a motor 145 (not shown in FIG. 13) functioning in substantially the same manner as in device 10 and device 300. However, device 400 differs somewhat from device 10 and device 300 in that nail polish removing fluid may be provided to scrubbing member 25 by replacing the hand activated manual pump 55 (illustrated in FIG. 1) with an electric or otherwise automated pump. Such a pump is well-known in the art and typically operates by pressurizing the nail polish removing fluid held in container 50 thereby providing the fluid to the previously illustrated systems for distributing the fluid to the scrubbing member 25. In a preferred embodiment of the present invention, the electric pump supplies the nail polish removing fluid to the distribution system in a quantity sufficient to efficiently, conveniently and cleanly remove nail polish while simultaneously minimizing waste of nail polish removing fluid. This preferred embodiment also ensures that fresh, clean nail polish removing fluid is provided thereby creating a sanitary nail polish removal for the user. In a further preferred embodiment, the distribution system provides the nail polish removing fluid to the scrubbing member 25 in a mist, small droplet, atomized or similar form.

FIG. 13 further illustrates a cleaning member 460. Said cleaning member 460 is characterized by grooves, recesses, striations, and the like, that are in contact with the scrubbing member 25 and facilitate the removal of used polish, dirt and other debris from the scrubbing member 25. In a preferred embodiment, the cleaning member 460 extends about 0.5 mm into the outside perimeter of the scrubbing member 25.

Figure 14:
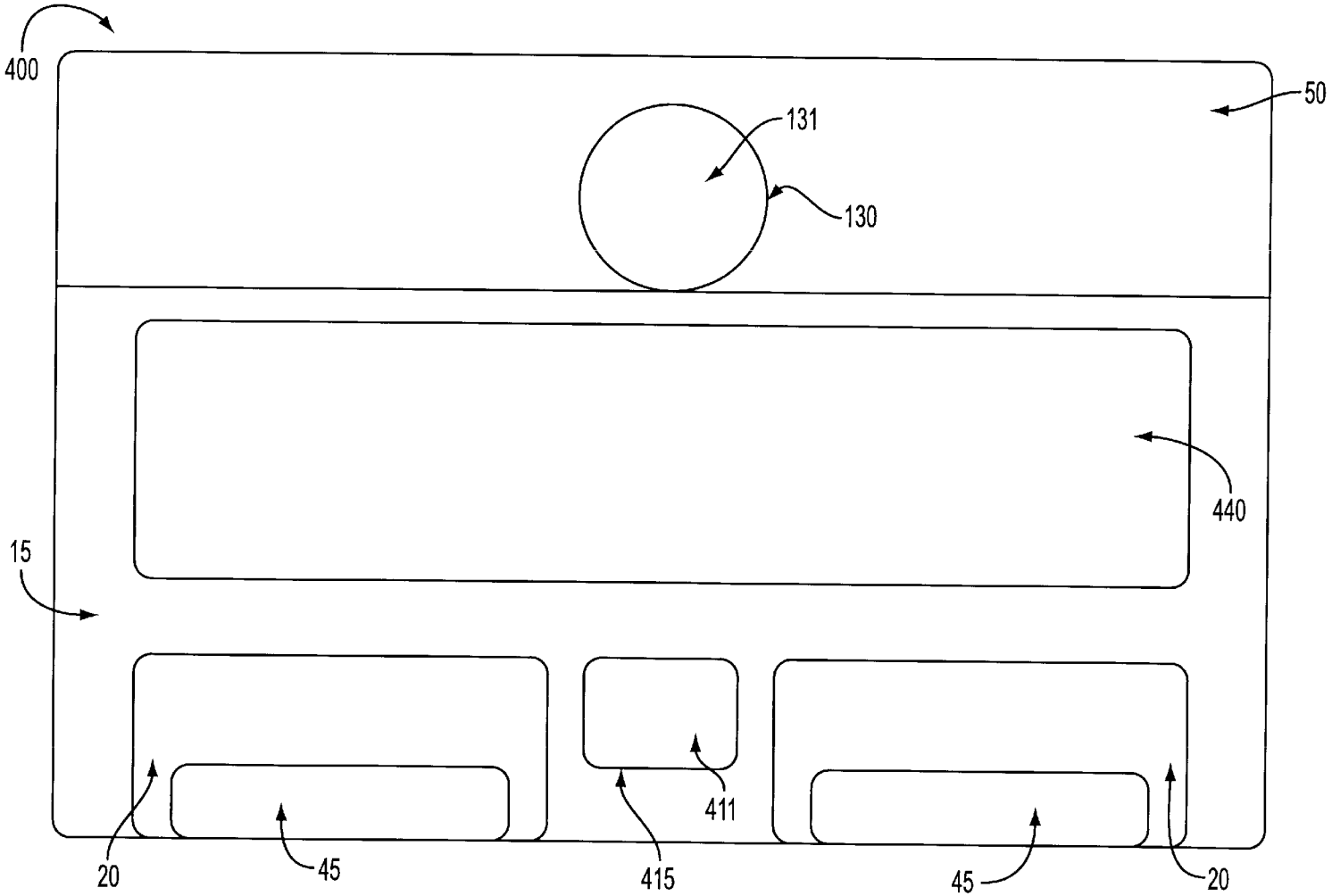
FIG. 14 is a top view of the nail polish removing device illustrated in FIG. 12, which further illustrates advantageous features of the present invention.

FIG. 14 is a top view of the nail polish removing device 400 illustrated in FIG. 10, which further illustrates advantageous features of the present invention.

As illustrated in FIG. 14, lid 440 is coupled in a movable fashion to base 15 . When in a closed position, lid 440 prevents spraying or expulsion of nail polish removing fluid from areas 20 and area 415 by the rotational movements of scrubbing member 25. Lid 440, when in an open position, allows convenient access to scrubbing member 25.

Although the present invention has been described in terms of particularly preferred embodiments, it is not limited to these embodiments. Alternative embodiments and modifications which would still be encompassed by the invention may be made by those skilled in the art, particularly in light of the foregoing teachings. Therefore, the following claims are intended to cover any alternative embodiments, modifications or equivalents which may be within the spirit and scope of the invention as defined by the claims.

I claim:

1. A device capable of removing nail polish, the device comprising:

a scrubbing member housed within a base, the base further comprising a first area for simultaneously receiving a plurality of fingers of a first hand or toes of a first foot for positioning adjacent to the scrubbing member, and a second area for receiving a single finger of a second hand or a single toe of a second foot for positioning adjacent to the scrubbing member;

a container coupled to the base for holding nail polish removing fluid, the container holding the nail polish removing fluid separate from the first area and the second area of the base;

a nozzle adapted for selectively delivering nail polish removing fluid to the scrubbing member; and a pump connected to the container for selectively pumping nail polish removing fluid from the container and through the nozzle to the scrubbing member.

2. The device of claim 1, wherein the base further comprises a third area for simultaneously receiving a plurality of fingers of the second hand or toes of the second foot for positioning adjacent to the scrubbing member.

3. The device of claim 2, wherein the pump is an electric pump.

4. The device of claim 3, wherein the electric pump is capable of being actuated while the plurality of toes of the first foot are positioned in the first area of the base and the plurality of toes of the second foot are positioned in the third area of the base.

5. The device of claim 1, wherein the device further comprises a sanitizing element.

6. The device of claim 5, wherein the sanitizing element sterilizes the first area, the second area and the scrubbing member.

7. The device of claim 5, wherein the sanitizing element comprises an ultraviolet light or a sterilizing fluid.

8. The device of claim 1, wherein the scrubbing member is rotatable.

9. The device of claim 1, wherein the scrubbing member comprises a brush or a sponge.

10. The device of claim 1, wherein the pump is a manual pump.

11. The device of claim 10, wherein the manual pump is capable of being actuated by a second hand while the plurality of fingers of the first hand or toes of the first foot are positioned in the first area of the base.

12. The device of claim 10, wherein the manual pump is capable of being actuated by a first hand while the single finger of the second hand or the toe of the second foot is positioned in the second area of the base.

13. The device of claim 10, wherein actuation of the manual pump causes the nozzle to move downward toward the scrubbing member such that the nail polish removing fluid is delivered to the scrubbing member.

14. The device of claim 1, wherein the container is selectively removable from the base.

15. The device of claim 1, wherein the pump is an electric pump.

16. The device of claim 1, wherein the device further comprises a cleaning member which is in contact with the scrubbing member while the scrubbing member rotates.

17. The device of claim 1, wherein the device further comprises a switch for engagement by a palm of the first hand or sole of the first foot such that the switch can be actuated by the palm or the sole when the plurality of fingers of the first hand or toes of the first foot are positioned in the first area of the base.

18. A device capable of removing nail polish, the device comprising:

a scrubbing member housed within a base, the base further comprising a first area for simultaneously receiving a plurality of fingers of a first hand or toes of a first foot for positioning adjacent to the scrubbing member, and a second area for simultaneously receiving a plurality of fingers of a second hand or toes of a second foot for positioning adjacent to the scrubbing member; and a removable drain pan coupled to the base below the first area and the second area for collecting used nail polish removing fluid, wherein the drain pan is removable for disposing of the used nail polish removing fluid.

19. The device of claim 18, wherein the base further comprises a third area for receiving a single finger or a single toe for positioning adjacent to the scrubbing member.

20. The device of claim 18, wherein the device further comprises a sanitizing element.

21. The device of claim 20, wherein the sanitizing element comprises ultraviolet light or sanitizing fluid.

22. The device of claim 20, wherein the sanitizing element sanitizes the first area, the second area and the scrubbing member.

23. The device of claim 18, wherein the device further comprises a switch for engagement by a palm of the first hand or sole of the first foot such that the switch can be actuated by the palm or the sole when the plurality of fingers of the first hand or toes of the first foot are positioned in the first area of the base.

24. The device of claim 18, wherein the device further comprises a switch for engagement by a palm of the second hand or sole of the second foot such that the switch can be actuated by the palm or the sole when the plurality of fingers of the second hand or toes of the second foot are positioned in the second area of the base.

25. The device of claim 18, wherein the device further comprises a cleaning member which is in contact with the scrubbing member while the scrubbing member rotates in order to clean the scrubbing member.

26. A device capable of removing nail polish, the device comprising:

a scrubbing member housed within a base, the base further comprising a first area for simultaneously receiving a plurality of fingers of a first hand or toes of a first foot for positioning adjacent to the scrubbing member, and a second area for simultaneously receiving a single finger of the first hand or a single toe of the first foot for positioning adjacent to the scrubbing member;

a container coupled to the base for holding nail polish removing fluid, wherein the container is removable from the housing; and a pump connected to the container for controllably distributing nail polish removing fluid from the container to the scrubbing member.

27. The device of claim 26, wherein the base further comprises a third area for simultaneously receiving a plurality of fingers of a second hand or toes of a second foot for positioning adjacent to the scrubbing member.

28. The device of claim 26, wherein the pump is an electric pump.

29. The device of claim 26, wherein the pump is a manual pump.

30. The device of claim 29, wherein the manual pump is adapted for actuation by a second hand while the plurality of fingers of the first hand or toes of the first foot are positioned in the first area of the base.

31. The device of claim 29, wherein the manual pump is adapted for actuation by a second hand while the single finger of the first hand or the toe of the first foot is positioned in the second area of the base.

32. The device of claim 26, wherein the pump includes a nozzle for delivering nail polish removing fluid from the container to the scrubbing member.

33. The device of claim 32, wherein actuation of the pump by a second hand causes the nozzle to move downward toward the scrubbing member such that nail polish removing fluid is delivered in close proximity to the scrubbing member.

34. The device of claim 26, wherein the base further comprises a lid movably coupled to the base such that the lid, in a first lid position, helps prevent nail polish removing fluid from being expelled from the base during operation of the scrubbing member, and, in a second lid position, enables removal of the scrubbing member from the base.

35. The device of claim 26, wherein the base further comprises a scrubbing member storage area in the base for storing a replacement scrubbing member.

36. The device of claim 26, wherein the base further comprises a drain pan positioned below the first area and second area for collecting nail polish removing fluid runoff from the scrubbing member.

37. The device of claim 36, wherein the drain pan is removable from the base.

38. A device capable of removing nail polish, the device comprising:

a rotatable member housed within a base, the base further comprising a first area for simultaneously receiving a plurality of fingers of a first hand or toes of a first foot for positioning adjacent to the rotatable member, and a second area for receiving a single finger of a second hand or a single toe of a second foot for positioning adjacent to the rotatable member; and a cleaning device, said cleaning device being in contact with the rotatable member while the rotatable member is rotated in order to clean the rotatable member.

39. The device of claim 38, wherein the cleaning device comprises a plurality of parallel striations in contact with the rotatable member.

40. A device for removing nail polish comprising:

a base having a first digit receiving area adapted for simultaneously receiving a plurality of nails of digits of a first limb;

a second digit receiving area adapted for receiving a single nail of a single digit of the first limb or a second limb;

a scrubbing member coupled to the base such that the plurality of the nails of the digits are positioned adjacent to the scrubbing member when the plurality of the nails of the digits are positioned in the first digit receiving area and such that the single nail of the single digit is positioned adjacent to the scrubbing member when the single nail of the single digit is positioned in the second digit receiving area of the base;

a motor operatively connected to the scrubbing member for causing relative movement between the scrubbing member and the plurality of nails or the single nail when the motor is actuated;

a switch electrically coupled to the motor such that actuation of the switch causes the motor to be actuated and thereby enable removal of the nail polish from the plurality of nails or the single nail;

a container coupled to the base for holding nail polish removing fluid, the container holding the nail polish removing fluid separate from the first digit receiving area and the second digit receiving area of the base, the container being selectively removable from the base; and a fluid pump connected to the container for selectively distributing nail polish removing fluid from the container to the scrubbing member.

41. The device of claim 40, wherein the fluid pump is an electric pump.

42. The device of claim 40, wherein the fluid pump is a manual pump.

43. The device of claim 42, wherein the manual pump is adapted for actuation by the second limb while the plurality of nails of digits of the first limb are positioned in the first area of the base.

44. The device of claim 42, wherein the manual pump is adapted for actuation by the second limb while the single nail of the digit of the first limb is positioned in the second area of the base.

45. The device of claim 42, wherein the manual pump includes a nozzle for delivering nail polish removing fluid from the container to the scrubbing member.

46. The device of claim 45, wherein actuation of the manual pump causes the nozzle to move downward toward the scrubbing member such that nail polish removing fluid is delivered in close proximity to the scrubbing member.

47. A device capable of removing nail polish, the device comprising:

a rotatable member housed within a base, the base further comprising a first area for simultaneously receiving a plurality of digits for positioning adjacent to the rotatable member, and a second area for receiving a single digit for positioning adjacent to the rotatable member;

a container coupled to the base for holding nail polish removing fluid, the container holding the nail polish removing fluid separate from the first area and the second area of the base, the container being selectively removable from the base; and a cleaning device which is in contact with the rotatable member while the rotatable member is rotated in order to clean the rotatable member.

48. The device of claim 47, wherein the base further comprises a third area for simultaneously receiving a plurality of digits for positioning adjacent to the rotatable member.

49. The device of claim 47, wherein the digit comprises a finger and the digits comprise fingers.

50. The device of claim 47, wherein the digit comprises a toe and the digits comprise toes.

51. The device of claim 47, wherein the base further comprises a removable drain pan positioned below the first area and the second area to collect nail polish removing material runoff.

52. An automated nail polish remover comprising:

a housing;

a first area of the housing adapted to receive a plurality of digits;

a second area of the housing adapted to receive a single digit;

first means for simultaneously removing nail polish from the plurality of digits, the first means operatively positioned with respect to the first area and the second area; and second means formed in the housing for receiving a separate container of nail polish removing material and for permitting the separate container to be removed from the housing.

53. The automated nail polish remover of claim 52, wherein the automated nail polish remover further comprises third means for sanitizing the first means.

54. The automated nail polish remover of claim 52, wherein the second means is contoured to receive the separate container.

55. The automated nail polish remover of claim 52, wherein the second means is positioned to locate the separate container in a position to enable contents of the separate container to be dispensed toward the first means.

56. The automated nail polish remover of claim 52, wherein the remover further comprises a separate container for holding nail polish removing material and means for dispensing the nail polish removing material towards the first means.

57. The automated nail polish remover of claim 52, wherein the first means comprise a scrubbing member and a separate container for holding nail polish removing material, the separate container comprising means for directing the nail polish removing material to a desired portion of the scrubbing member.

* * * * *